United States Patent [19]

Hamburg et al.

[11] Patent Number: 4,736,724

[45] Date of Patent: Apr. 12, 1988

[54] ADAPTIVE LEAN LIMIT AIR FUEL CONTROL USING COMBUSTION PRESSURE SENSOR FEEDBACK

[75] Inventors: Douglas R. Hamburg, Birmingham; Gottfried Hogh, Ann Arbor; Gerald P. Lawson, Romeo, all of Mich.

[73] Assignee: Ford Motor Company, Dearborn, Mich.

[21] Appl. No.: 936,578

[22] Filed: Dec. 1, 1986

[51] Int. Cl.[4] ..... F02D 41/14; F02D 41/04

[52] U.S. Cl. ..... 123/435; 123/436

[58] Field of Search ..... 123/425, 435, 436

[56] References Cited

U.S. PATENT DOCUMENTS

| | | | |
|---|---|---|---|
| 3,969,614 | 7/1976 | Moyer et al. . | |
| 4,216,750 | 8/1980 | Kobayashi | 123/435 |
| 4,391,248 | 7/1983 | Latsch | 123/435 X |
| 4,535,740 | 8/1985 | Ma | 123/435 |
| 4,543,934 | 10/1985 | Morita et al. | 123/435 |
| 4,622,939 | 11/1986 | Matekunas | 123/425 |

FOREIGN PATENT DOCUMENTS

| | | | |
|---|---|---|---|
| 46352 | 3/1984 | Japan | 123/435 |
| 113244 | 6/1984 | Japan | 123/435 |
| 249644 | 12/1985 | Japan | 123/435 |

*Primary Examiner*—Tony M. Argenbright

*Attorney, Agent, or Firm*—Allan J. Lippa; Peter Abolins

[57] ABSTRACT

Controlling operation of an internal combustion engine at lean air fuel ratios uses an in-cylinder pressure sensor. The in-cylinder pressure sensor is coupled to each cylinder of the engine and measures in-cylinder pressure and generates an output signal as a function of such pressure. Airflow into the engine is also sensed and both the airflow and in-cylinder pressure are applied to the fuel controller for generating a fuel injection drive signal. Compensation means coupled to the in-cylinder pressure sensor means and airflow indication means modify the fuel air command applied to the engine as a function of airflow and in-cylinder pressure. The compensation means is also coupled to the fuel controller for applying a fuel command signal to the fuel controller thereby permitting engine operation at the lean air fuel ratio limit.

6 Claims, 1 Drawing Sheet

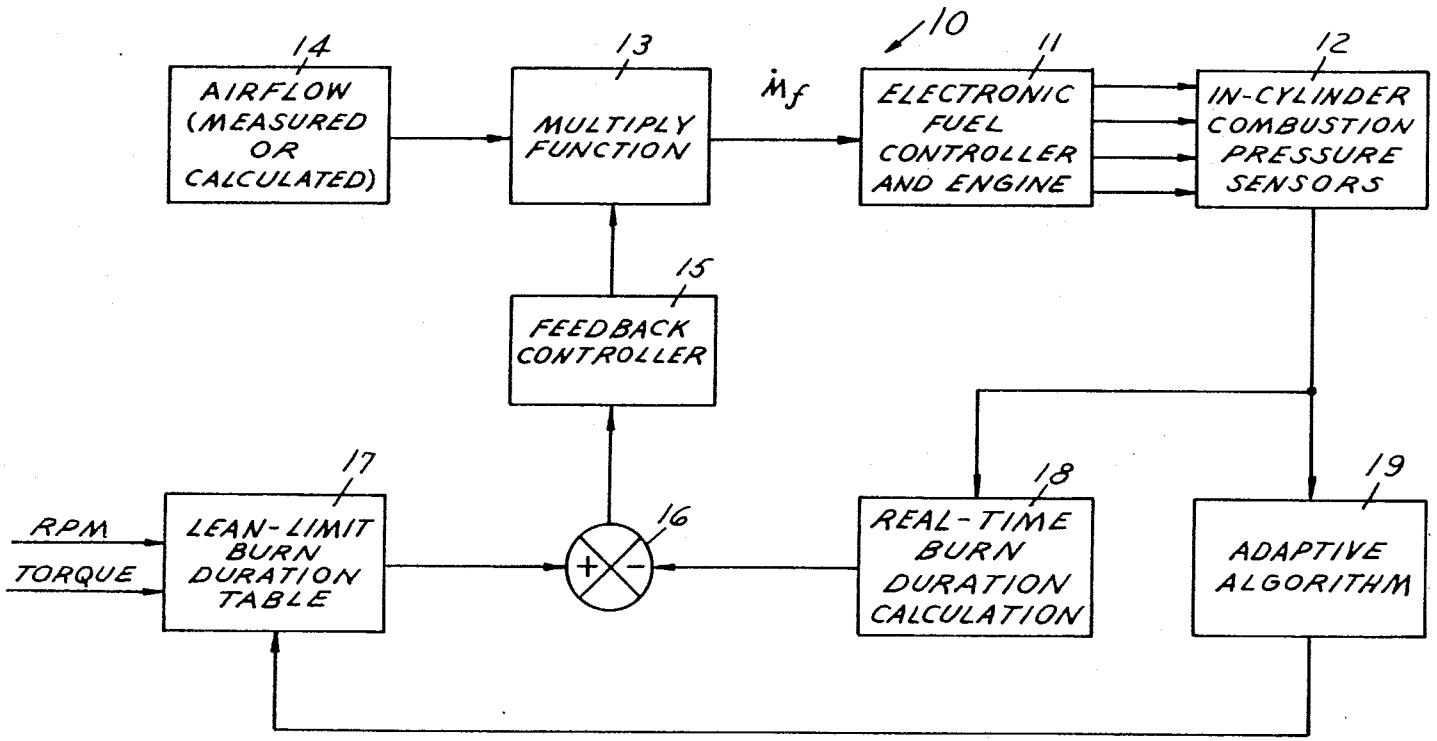
10
11
ELECTRONIC FUEL CONTROLLER AND ENGINE
12
IN-CYLINDER COMBUSTION PRESSURE SENSORS
13
MULTIPLY FUNCTION
14
AIRFLOW (MEASURED OR CALCULATED)
15
FEEDBACK CONTROLLER
16
17
LEAN-LIMIT BURN DURATION TABLE
18
REAL-TIME BURN DURATION CALCULATION
19
ADAPTIVE ALGORITHM
$\dot{m}_f$
RPM
TORQUE

ADAPTIVE LEAN LIMIT AIR FUEL CONTROL USING COMBUSTION PRESSURE SENSOR FEEDBACK

BACKGROUND OF THE INVENTION

1. Field of the Invention

This invention relates to electronic engine control.

2. Prior Art

Various means for controlling engines electronically are known. For example, U.S. Pat. No. 3,969,614 issued to Moyer et al teaches a method and apparatus for engine control. Adjustments to controlling the energy conversion function of an engine are obtained by sensing at least one engine operating condition, developing an electrical signal indicative of such condition, and, with a digital computer, calculating repetitively values corresponding to settings of the means used to control the energy conversion function of the engine. The digital computer is programmed to calculate these values or settings arithmetically from an algebraic function or functions describing a desired relationship between settings of the energy conversion control means and the sensed condition.

Typical control variables include the throttle angle, fuel flow per cycle, fuel injection timing, ignition timing, and, if EGR is used, the amount of exhaust gases recirculated through the engine. To effect control of these variables that determine the characteristics of the energy conversion process, various engine conditions may be sensed while the engine is operative. Thus, one or more of the following variable engine conditions may be sensed: crankshaft position, engine speed, mass airflow into the engine, intake manifold pressure, throttle angle, EGR valve position, throttle angle rate of change, engine speed rate of change, fuel temperature, fuel pressure, EGR valve rate of change, vehicle speed and acceleration, engine coolant temperature, engine torque, air to fuel ratio, exhaust emissions, etc.

It has been found that there are conditions when it is advantageous to operate with a very lean air fuel ratio. For example, such operation may produce better fuel economy or reduce exhaust emissions. Known engine control systems have difficulty operating the engine at or near the limit of lean air fuel ratios. It would be desirable to find an engine control system that easily and reliably is able to control engine operation at lean air fuel ratios. These are some of the problems this invention overcomes.

SUMMARY OF THE INVENTION

In accordance with an embodiment of this invention, an apparatus for controlling operation of an internal combustion engine at lean air fuel ratios includes a fuel controller, an in-cylinder pressure sensor, an airflow indicator, and compensation means. The fuel controller generates a fuel injector drive signal for controlling introduction of fuel into the engine. The in-cylinder pressure sensor is coupled to each cylinder of the engine for measuring in-cylinder pressure and generating an output signal as a function of such in-cylinder pressure. The airflow indication means generates a signal indicative of the airflow into the engine. The compensation means is coupled to the in-cylinder pressure sensor, the airflow indication means and has an output coupled to the fuel controller. The compensation means modifies the fuel air command applied to the engine as a function of airflow and in-cylinder pressure thereby permitting engine operation at the lean air fuel ratio limit.

In accordance with an embodiment of this invention, an engine's air fuel ratio is maintained at the lean limit based on continuously measured in-cylinder combustion pressure signals. There is provided good transient air fuel ratio response because of the lean limit preprogramming of the burn duration table and the fast time response of the combustion pressure feedback loop. There is also provided accurate lean limit operation because of the updating, or adapting, of the burn duration table.

BRIEF DESCRIPTION OF THE DRAWING

The drawing is a block diagram of a lean limit engine controller using in-cylinder combustion pressure signals to maintain an engine's air fuel ratio at the lean limit in accordance with an embodiment of this invention.

DETAILED DESCRIPTION OF THE INVENTION

An engine system 10 includes an electronic fuel controller and engine 11 which has in-cylinder combustion pressure sensors 12 coupled to each of the cylinders of the engine. Electronic fuel controller and engine 11 receive an input from a multiply function apparatus 13 which has one input from an airflow indicator 14 and another input from a feedback controller 15 which is part of a feedback path from pressure sensors 12. More specifically, the feedback path includes a summer 16 which has one input from a lean limit burn duration table 17 and another input from real burn time duration calculation 18. Cylinder combustion pressure sensors 12 provide an output directly to the input of real time burn duration calculation 18 and provide an output to the input of lean limit burn duration table 17 through an adaptive algorithm function 19. Lean limit burn duration table 17 also has as inputs engine RPM and engine torque.

In operation, a feedback signal derived from in-cylinder combustion sensors 12 maintains the air fuel ratio of an engine at the lean limit for all RPM/torque operating conditions. Furthermore, the combustion pressure or feedback information is used to update or adapt a preprogrammed lean limit burn duration table 17 from which the basic fuel command to the engine's fuel control system 11 is obtained.

Lean limit burn duration table 17 is preprogrammed in the engine's onboard control computer as a function of engine RPM and engine torque and, if desired, engine spark ignition timing, to produce lean limit air fuel ratio conditions for all engine RPM and torque operating points which are expected to occur in any driving cycle. At any instant of time, the predetermined lean limit burn duration corresponding to the RPM and torque existing at that time will be extracted from burn duration table 17 and compared with the actual burn duration value computed from the combustion pressure signal fed back from the appropriate cylinder pressure sensor 12.

The resulting error signal produced by summer 16 is processed by feedback controller 15 having a suitable algorithm, for example, proportional-integral, to generate a fuel air command signal. The fuel air command signal is then multiplied by an airflow signal, either measured with an airflow meter or calculated using a convention speed density algorithm to produce the actual fuel command as an output of multiply function apparatus 13, $\dot{M}_f$. The fuel command is then applied to a conventional electronic fuel controller in engine 11, advantageously, with some form of transient fuel compensation and multicylinder capability, to generate pulse width modulated fuel injector drive signals which will produce lean limit operation for each individual cylinder.

Advantageously, one parameter of the combustion pressure feedback signal, for example, the variability, can be used to update, i.e. adapt, the lean limit burn duration table 17 to eliminate any lean limit burn duration errors determined from the combustion pressure measurements. This adapting process is accomplished by using the process combustion pressure signals to change the lean limit values in the proper RPM/torque regions of the burn duration table 17 corresponding to the particular operating conditions where the error was observed. Such adaptation of burn duration table 17 is carried out when the engine has been operating at any particular RPM/torque condition for a sufficiently long period of time, for example, several seconds, so that the dynamic effects are not significant. To avoid abrupt transitions from one region of the table to another, any time a burn time correction is made, a somewhat smaller correction will be made in each of the adjacent RPM/torque regions in the burn duration table.

Various modifications and variations will no doubt occur to those skilled in the art to which this invention pertains. For example, the particular characteristics of the lean limit burn duration table may be varied from that disclosed herein. These and all other variations which basically rely on the teachings through which this disclosure has advanced the art are properly considered within the scope of this invention.

We claim:

1. An apparatus for controlling operation of an internal combustion engine at lean air fuel ratios comprising:
   - a fuel controller means for generating a fuel injector drive signal;
   - an in-cylinder pressure sensor means coupled to each cylinder of the engine for measuring in-cylinder pressure and generating an output signal as a function of such in-cylinder pressure;
   - an airflow indication means for generating a signal indicative of airflow into the engine;
   - compensation means coupled to said in-cylinder pressure sensor means and said airflow indication means for modifying the fuel air command applied to the engine as a function of airflow and in-cylinder pressure, and coupled to said fuel controller means for applying a fuel command signal to said fuel controller means thereby permitting engine operation at the lean air fuel ratio limit; and
   - said compensation means further comprises a real-time burn duration calculation means for calculating the actual burn duration in the cylinders of the engine; a lean limit burn duration table receiving inputs characterizing in-cylinder combustion pressure and engine rpm and engine torque, said table storing engine control information suitable for producing lean limit air fuel ratio conditions for any desired engine rpm and torque operating points; and a summer means having inputs coupled to said real-time burn duration calculation means and said lean limit burn duration table and producing a resulting error signal as an output.

2. An apparatus for controlling operation of an internal combustion engine at lean air fuel ratios as recited in claim 1 wherein said compensation means includes:
   - a feedback controller means having an input coupled to said summer means and generating a fuel air command signal as an output; and
   - a multiply function means coupled to said airflow indication means and to said feedback controller means so as to produce the actual fuel command signal as a function of the outputs of said feedback controller means and said airflow indication means.

3. An apparatus for controlling operation of an internal combustion engine at lean air fuel ratios as recited in claim 2 wherein said compensation means includes:
   - an adaptive algorithm means having an input coupled to said in-cylinder pressure sensor means and an output coupled to said lean limit burn duration table means for adapting the information stored in said lean limit burn duration table when the engine has been operating at any particular rpm and torque condition for a sufficiently long period of time so that the dynamic effects of changes in engine rpm and torque are not significant.

4. A method for controlling engine operation at a lean fuel air ratio, comprising the steps of:
   - applying a fuel injector control signal to fuel injectors of the engine as a function of a stored schedule of fuel command signals;
   - calculating the real-time burn duration of combustion in the cylinders;
   - generating a predetermined lean limit burn duration corresponding to stored engine operating data as a function of engine rpm and torque;
   - comparing the generated and calculated durations and generating an error signal;
   - generating a signal indicative of the airflow into the engine; and
   - modifying the fuel injector control signal as a function of the error signal and the airflow signal.

5. A method for controlling engine operation at a lean fuel air ratio as recited in claim 4 further comprising the step of modifying the error signal as a function of the signal indicative of the airflow signal.

6. A method for controlling engine operation at a lean fuel air ratio as recited in claim 5 further comprising the step of adaptively modifying the information stored in the lean limit burn duration table as a function of actual sensed in-cylinder combustion pressure.

* * * * *